US010891888B2

(12) United States Patent
Wu et al.

(10) Patent No.: US 10,891,888 B2
(45) Date of Patent: Jan. 12, 2021

(54) DISPLAY DEVICE CAPABLE OF MONITORING VOLTAGE OF PIXEL ARRAY

(71) Applicant: InnoLux Corporation, Miao-Li County (TW)

(72) Inventors: Hung-Chiao Wu, Miao-Li County (TW); Ho-Tien Chen, Miao-Li County (TW); Kuan-Hsien Huang, Miao-Li County (TW)

(73) Assignee: InnoLux Corporation, Miao-Li County (TW)

( * ) Notice: Subject to any disclaimer, the term of this patent is extended or adjusted under 35 U.S.C. 154(b) by 0 days.

(21) Appl. No.: 16/550,277

(22) Filed: Aug. 25, 2019

(65) Prior Publication Data

US 2020/0090572 A1 Mar. 19, 2020

Related U.S. Application Data

(60) Provisional application No. 62/731,985, filed on Sep. 17, 2018.

(30) Foreign Application Priority Data

Apr. 19, 2019 (CN) ..... 2019 1 0319645

(51) Int. Cl.
*G09G 3/36* (2006.01)
*G09G 3/20* (2006.01)

(52) U.S. Cl.
CPC ..... *G09G 3/20* (2013.01); *G09G 2320/029* (2013.01); *G09G 2330/021* (2013.01); *G09G 2330/028* (2013.01); *G09G 2330/04* (2013.01)

(58) Field of Classification Search
CPC .. G09G 3/30; G09G 3/32; G09G 3/34; G09G 3/36; G09G 5/02; G09G 5/00; G09G 3/10; G06F 3/038
See application file for complete search history.

(56) References Cited

U.S. PATENT DOCUMENTS

2004/0095113 A1 5/2004 Kernahan
2006/0158128 A1* 7/2006 Hu ..... G09G 3/3208 315/169.3
2013/0162617 A1 6/2013 Yoon
2015/0015137 A1* 1/2015 Kang ..... H05B 45/60 313/504
2017/0025061 A1* 1/2017 Takizawa ..... G09G 3/3291
2017/0206837 A1* 7/2017 Jeon ..... G09G 3/3225

FOREIGN PATENT DOCUMENTS

EP 2 722 841 A1 4/2014

* cited by examiner

*Primary Examiner* — Pegeman Karimi
(74) *Attorney, Agent, or Firm* — Winston Hsu

(57) ABSTRACT

A display device includes a pixel array, a power line, a ground line, at least one power detection line, at least one ground detection line, and a power supply circuit. The power supply circuit configured to provide to the pixel array a supply voltage via the power line and a ground voltage via the ground line, receive from the pixel array at least one detected supply voltage via the at least one power detection line and at least one detected ground voltage via the at least one ground detection line, and adjust the supply voltage and/or the ground voltage according to the at least one detected supply voltage and the at least one detected ground voltage.

9 Claims, 4 Drawing Sheets

DISPLAY DEVICE CAPABLE OF MONITORING VOLTAGE OF PIXEL ARRAY

CROSS REFERENCE TO RELATED APPLICATION

This non-provisional application claims priority of US provisional application No. 62/731,985, filed on 17 Sep. 2018 and China patent application No. 201910319645.4, filed on 19 Apr. 2019, included herein by reference in its entirety.

BACKGROUND OF THE DISCLOSURE

1. Field of the Disclosure

The invention relates to a display device, and in particular, to a display device capable of monitoring a voltage of a pixel array.

2. Description of the Prior Art

Display devices such as smart phones, tablets, notebooks, displays and televisions have become necessities of modern life. As development of the display devices continues to advance, users now have high expectations for quality, functions and prices of the products.

Nevertheless, stability of display devices is still a primary objective of development in the industry.

SUMMARY OF THE DISCLOSURE

In one embodiment, a display device includes a pixel array, a power line, a ground line, at least one power detection line, at least one ground detection line, and a power supply circuit. The power supply circuit configured to provide to the pixel array a supply voltage via the power line and a ground voltage via the ground line, receive from the pixel array at least one detected supply voltage via the at least one power detection line and at least one detected ground voltage via the at least one ground detection line, and adjust the supply voltage and/or the ground voltage according to the at least one detected supply voltage and the at least one detected ground voltage.

These and other objectives of the present disclosure will no doubt become obvious to those of ordinary skill in the art after reading the following detailed description of the embodiment that is illustrated in the various figures and drawings.

DETAILED DESCRIPTION

Figure 1:
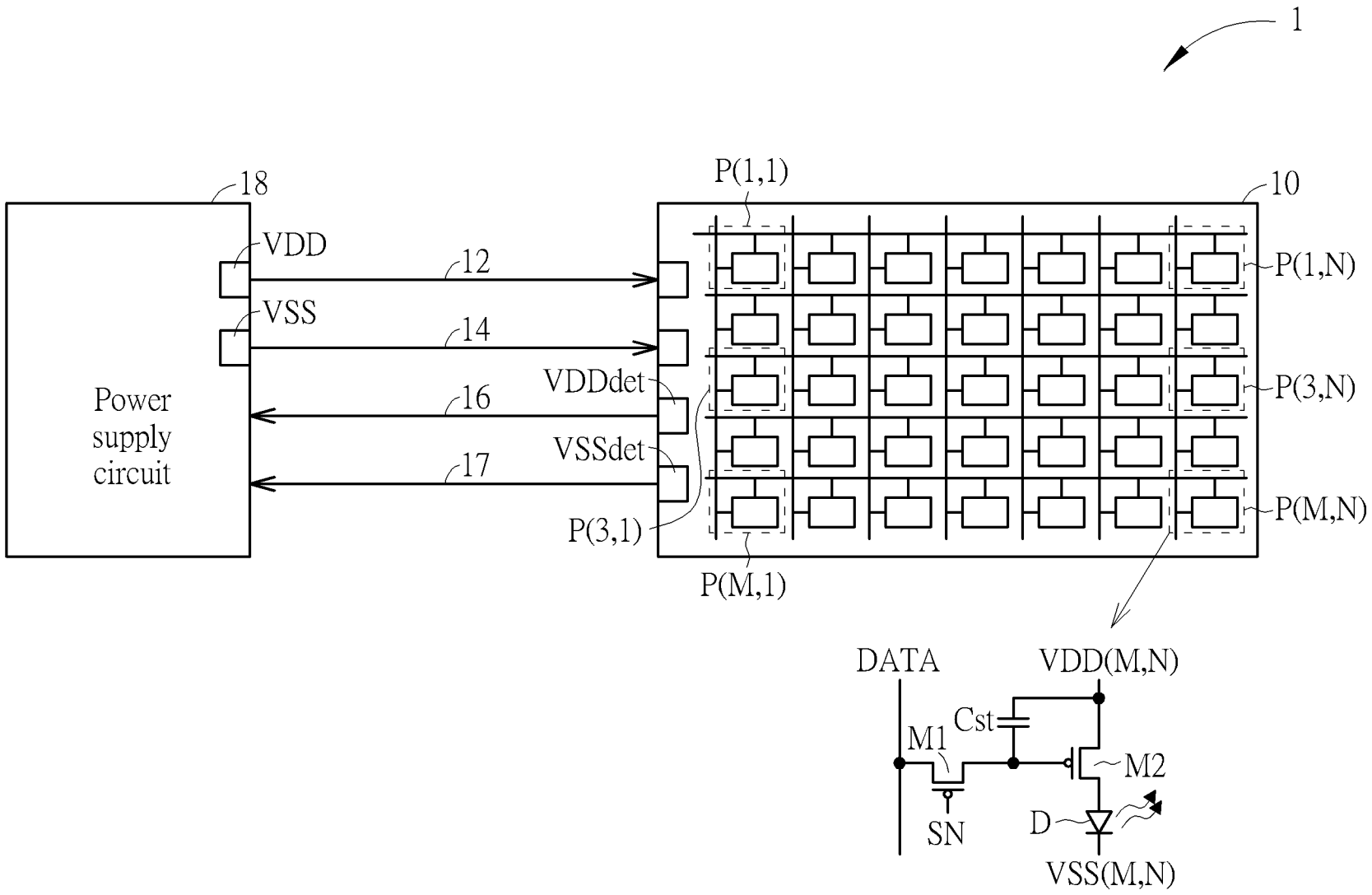
FIG. 1 is a system diagram of a display device according to an embodiment of the invention.

FIG. 1 is a system diagram of a display device 1 according to an embodiment of the invention. The display device 1 may include, but is not limited to, a flexible display device, a touch display device, a curved display device, a tiled display device, another appropriate display device or a combination thereof. The display device 1 may comprise a pixel array 10, a power line 12, a ground line 14, at least one power detection line 16, at least one ground detection line 17 and a power supply circuit 18. The power supply circuit 18 may provide, to the pixel array 10, a supply voltage VDD via the power line 12 and a ground voltage VSS via the ground line 14. In one embodiment, the ground voltage VSS may be, but is not limited to, a ground voltage, a pull-low voltage level or a reference voltage. In another embodiment, the supply voltage VDD and the ground voltage VSS may be, but are not limited to, controlled by an integrated circuit in the power supply circuit 18, and the supply voltage VDD and the ground voltage VSS may be, but are not limited to, obtained by measuring pins of the integrated circuit. The supply voltage VDD and/or the ground voltage VSS may produce a voltage drop during power transmission. The power supply circuit 18 may receive, from the pixel array 10, at least one detected supply voltage VDDdet via the at least one power detection line 16 and at least one detected ground voltage VSSdet via the at least one ground detection line 17. In one embodiment, the power supply circuit 18 may adjust the supply voltage VDD to compensate the voltage drop according to the at least one detected supply voltage VDDdet and adjust the ground voltage VSS to compensate the voltage drop according to the at least one detected ground voltage VSSdet. The at least one detected supply voltage VDDdet and/or the at least one detected ground voltage VSSdet may be obtained from selected locations on the pixel array 10 such as a selected pixel. For example, the power detection line 16 and/or the ground detection line 17 may be further connected to the power supply circuit 18 from the selected pixel. The power detection line 16 and/or the ground detection line 17 may also be connected to the power supply circuit 18 from a peripheral area of the pixel array 10. The at least one detected supply voltage VDDdet and/or the at least one detected ground voltage VSSdet may be, but are not limited to, measured from the above-mentioned locations such as from the peripheral area or the selected pixel. In some embodiments, the power supply circuit 18 may receive only the at least one detected supply voltage VDDdet or only the at least one detected ground voltage VSSdet. For example, since the quantity of the lines may be too large, the display device 1 may only include, but is not limited to, the power detection line 16 and not the ground detection line 17, the detected ground voltage VSSset may be replaced by a default value. The pixel array 10 may transmit the supply voltage VDD and the ground voltage VSS to pixels of the pixel array 10 to serve as a supply voltage and a ground voltage of the pixels. The at least one power detection line 16 and the at least one ground detection line 17 may include a plurality of power detection lines 16 and a plurality of ground detection lines 17, or may include a single power detection line 16 and a single ground detection line 17. The at least one detected supply voltage VDDdet and/or the at least one detected ground voltage VSSdet may include a plurality of detected supply voltages VDDdet and a plurality of detected ground voltages VSSdet, or may only include a single detected supply voltage VDDdet and a single detected ground voltage VSSdet.

In one embodiment, the pixel array 10 may include a plurality of pixels P. A specific pixel P in the pixel array 10 may be represented by P(m,n), with m being a row index and n being a column index, and m and n being integers where $M \geq m \geq 1$, $N \geq n \geq 1$. Each pixel P(m,n) may include transistors M1, M2, a capacitor Cst and a light-emitting component D, and may be coupled to a supply voltage VDD(m,n) and a ground voltage VSS(m,n). Owing to line resistance, pixel supply voltages VDD(m,n) and pixel ground voltages VSS (m,n) of different pixels P(m,n) may be different. A circuit designer may obtain corresponding pixel supply voltages VDD(m,n) and pixel ground voltages VSS(m,n) from locations of a plurality of pixels P(m,n) according to the size of the pixel array 10, to serve as a plurality of detected supply voltages VDDdet(m,n) and a plurality of detected ground voltages VSSdet(m,n). For example, supply voltages VDD (1,1), VDD(1,N), VDD(3,1), VDD(3,N), VDD(M,1),VDD (M,N) may be obtained from the locations of pixels P(1,1), P(1,N), P(3,1), P(3,N), P(M,1), P(M,N) to serve as a plurality of detected supply voltages VDDdet(1,1), VDDdet (1,N), VDDdet (3,1), VDDdet (3,N), VDDdet (M,1), VDDdet (M,N), respectively. Similarly, ground voltages VSS(1, 1), VSS(1,N), VSS(3,1), VSS(3,N), VSS(M,1), VSS(M,N) may be obtained to serve as a plurality of detected supply voltages VSSdet(1,1), VSSdet (1,N), VSSdet (3,1), VSSdet (3,N), VSSdet (M,1), VSSdet (M,N), respectively. The invention is not limited to the example, and any number of pixels may be selected as required. The plurality of detected supply voltages VDDdet and the plurality of detected ground voltages VSSdet may be obtained from different locations on the pixel array 10. For example, when the display device 1 is applied in a tiled display device, the plurality of detected supply voltages VDDdet and the plurality of detected ground voltages VSSdet may be obtained from pixels at an edge or a corner location of the pixel array 10, so as to keep the brightness of edge pixels or corner pixels of the pixel array 10 to be substantially identical.

In one embodiment, the power supply circuit 18 may adjust the supply voltage VDD and/or the ground voltage VSS using the at least one detected supply voltage VDDdet and the at least one detected ground voltage VSSdet, so as to keep a difference between the supply voltage VDD and the ground voltage VSS to be within a tolerance, e.g., keeping the difference to be between 90% of a target and 100% of the target.

The pixel array 10 may comprise an active matrix pixel array, a passive matrix pixel array or a combination thereof. In one embodiment, the pixel array 10 may comprise a liquid crystal pixel array. In some embodiments, the light-emitting component D may comprise, but is not limited to, a light emitting diode (LED), an organic LED (OLED), a mini LED, a micro LED, a quantum dot LED (QD-LED, QLED), a phosphor material or a fluorescent material. The display device 1 is not limited to employing only one type of pixels P, and may employ different types of pixels such as using different light-emitting components. The embodiment provided herein does not serve as a limitation. In some embodiments, the at least one detected supply voltage VDDdet and the at least one detected ground voltage VSSdet may be obtained from the same or different locations on the pixel array 10.

Figure 2:
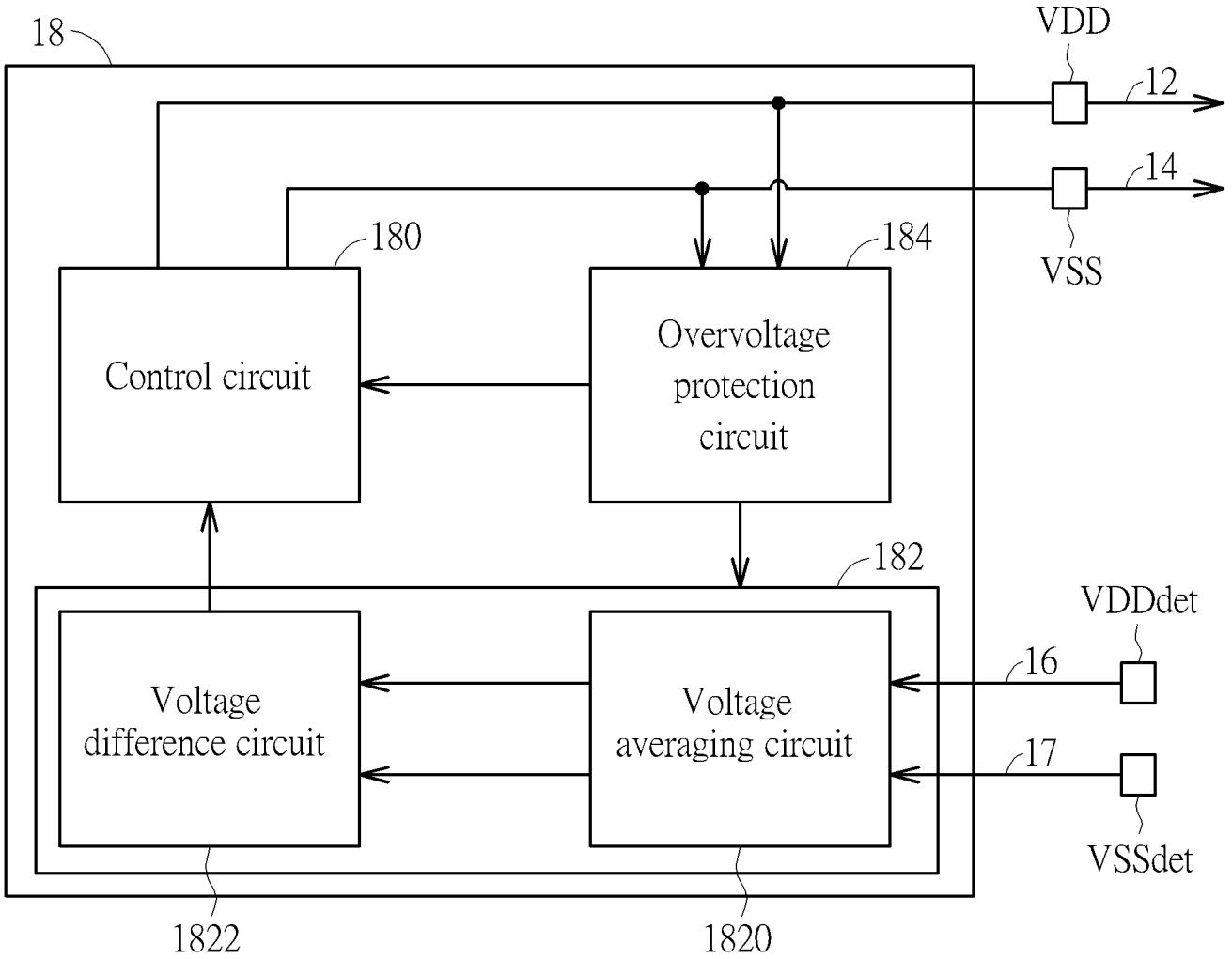
FIG. 2 is a block diagram of the power supply circuit in the display device in FIG. 1.

FIG. 2 is a block diagram of the power supply circuit 18 in the display device 1 according to embodiments of the invention. In some embodiments, the power supply circuit 18 may comprise a control circuit 180, a voltage compensation circuit 182, and an overvoltage protection circuit 184. The voltage compensation circuit 182 may comprise a voltage-averaging circuit 1820 and a voltage difference circuit 1822. The power supply circuit 18 may receive, from the pixel array 10, the at least one detected supply voltage VDDdet and/or the at least one detected ground voltage VSSdet via the at least one power detection line 16 and/or the at least one ground detection line 17 respectively. The voltage-averaging circuit 1820 may be coupled to the pixel array 10 via the at least one power detection line 16 and/or the at least one ground detection line 17. The voltage difference circuit 1822 may be coupled to the voltage-averaging circuit 1820. The control circuit 180 may be coupled to the voltage difference circuit 1822 and the overvoltage protection circuit 184. The control circuit 180 may be coupled to the pixel array 10 via the power line 12 and the ground line 14. The overvoltage protection circuit 184 may be coupled to the control circuit 180, the voltage compensation circuit 182, the power line 12 and the ground line 14.

In one embodiment, the voltage compensation circuit 182 and the control circuit 180 may compensate for voltage drops of the supply voltage VDD and/or the ground voltage VSS according to the at least one detected supply voltage VDDdet and/or the at least one detected ground voltages VSSdet. In particular, the voltage-averaging circuit 1820 may generate a supply voltage average according to the plurality of detected supply voltages VDDdet and/or a ground voltage average according to the plurality of detected ground voltages VSSdet. The voltage difference circuit 1822 may generate a difference according to the supply voltage average and the ground voltage average, and the control circuit 180 may update the supply voltage VDD and/or the ground voltage VSS according to the difference. In some embodiments, when the difference is less than a predetermined value, the control circuit 180 may increase the supply voltage VDD and/or decrease the ground voltage VSS. In other embodiments, when the difference exceeds a predetermined value, the control circuit 180 may decrease the supply voltage VDD and/or increase the ground voltage VSS.

When the control circuit 18 continuously increases the supply voltage VDD and/or decreases the ground voltage VSS as a result of a broken power detection line 16 and/or a broken ground detection line 17, the overvoltage protection circuit 184 may protect the circuit in the pixel array 10, reducing damages resulting from supply voltage VDD being too high and/or a low ground voltage VSS being too low. In some embodiments, when the supply voltage VDD exceeds a predetermined high voltage, the overvoltage protection circuit 184 may output an overvoltage signal to the control circuit 180 to update the supply voltage VDD with the predetermined high voltage, simultaneously, the control circuit 180 maintains a voltage difference between the supply voltage VDD and the ground voltage VSS to be within a tolerance of a target value, e.g., between 90% and 100% of a target voltage. In other embodiments, when the ground voltage VSS is lower than a predetermined low voltage, the overvoltage protection circuit 184 may output an overvoltage signal to the control circuit 180 to update the ground voltage VSS with the predetermined low voltage, simultaneously, the control circuit 180 maintains a voltage difference between the supply voltage VDD and the ground voltage VSS to be within a tolerance of a target value, e.g., between 90% and 100% of a target voltage. In other embodiments, when the supply voltage VDD exceeds the predetermined high voltage, the overvoltage protection circuit 184 may output the overvoltage signal to the control circuit 180 to update the supply voltage VDD with the predetermined high voltage, simultaneously, the control circuit 180 maintains the difference between the supply voltage VDD and the ground voltage VSS to be within the tolerance of the target voltage Vtarget, and when the supply voltage VSS is lower than the predetermined low voltage, the overvoltage protection circuit 184 may output the overvoltage signal to the control circuit 180 to update the ground voltage VSS with the predetermined low voltage, simultaneously, the control circuit 180 maintains the difference between the supply voltage VDD and the ground voltage VSS to be within the tolerance of the target voltage Vtarget. In other embodiments, when the supply voltage VDD exceeds the predetermined high voltage or the ground voltage VSS is lower than the predetermined low voltage, the overvoltage protection circuit 184 may disconnect the voltage compensation circuit 182 from the control circuit 180, to stop the control circuit 180 from updating the supply voltage VDD and/or the ground voltage VSS according to the detected supply voltage VDDdet and/or the detected ground voltage VSSdet.

In some embodiments, the power supply circuit 18 is not limited by FIG. 2, and may update the supply voltage VDD and/or the ground voltage VSS according to a single detected supply voltage VDDdet and/or a single detected ground voltage VSSdet. The power supply circuit 18 may comprise the voltage difference circuit 1822, the control circuit 180 and the overvoltage protection circuit 184. The voltage difference circuit 1822 may be coupled to the pixel array 10. The control circuit 180 may be coupled to the voltage difference circuit 1822, and the overvoltage protection circuit 184 may be coupled to the control circuit 180, the power line 12 and the ground line 14. In one embodiment, the voltage difference circuit 1822 may generate a difference according to the single detected supply voltage VDDdet and/or the single detected ground voltage VSSdet, and the control circuit 180 may update the supply voltage VDD and/or the ground voltage VSS according to the difference. When the supply voltage VDD exceeds the predetermined high voltage, the overvoltage protection circuit 184 may, but is not limited to, output the overvoltage signal to the control circuit 180 to update the supply voltage VDD with the predetermined high voltage.

Figure 3:
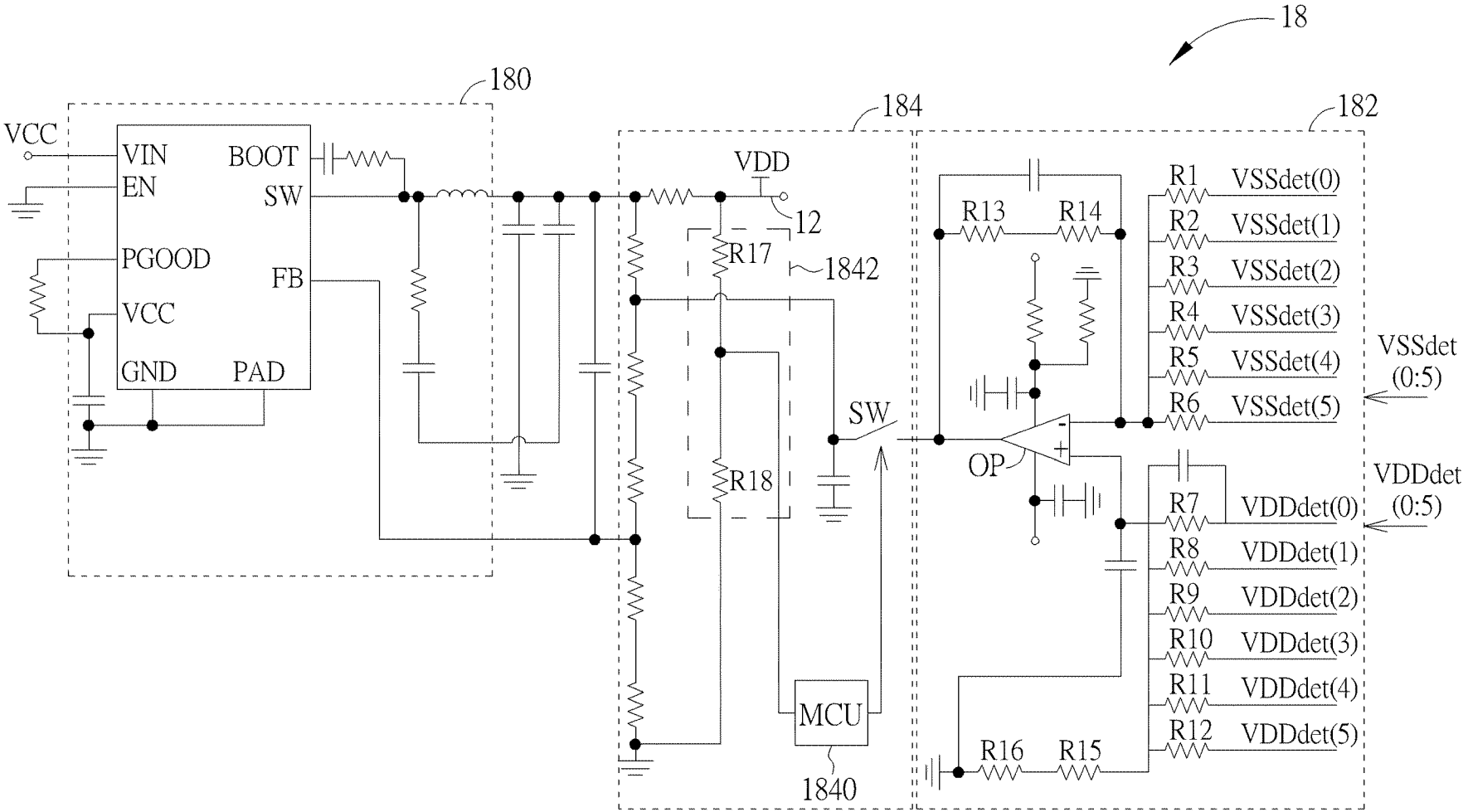
FIG. 3 is a circuit schematic of the power supply circuit in the display device in FIG. 1.

FIG. 3 is a circuit schematic of the power supply circuit 18 in the display device 1 in FIG. 1. In one embodiment, the power supply circuit 18 illustrated in FIG. 3 may be implemented in different way from what is shown in FIG. 2. The power supply circuit 18 may comprise a control circuit 180, a voltage compensation circuit 182 and an overvoltage protection circuit 184. The overvoltage protection circuit 184 may receive, but is not limited to, e.g., 6 detected supply voltages VDDdet (0:5) and/or 6 detected ground voltages VSSdet (0:5). The voltage compensation circuit 182 may be electrically connected to the control circuit 180, and electrically disconnected from the control circuit 180 when the voltage compensation circuit 182 detects an overvoltage. The overvoltage protection circuit 184 may be coupled to the power line 12, and coupled between the control circuit 180 and the voltage compensation circuit 182. The voltage compensation circuit 182 may comprise, for example, a weighted summer and/or a differential amplifier. In one embodiment, the voltage compensation circuit 182 may comprise resistors such as resistors R1 through R16 and an operational amplifier OP. An inverting terminal of the operational amplifier OP may be coupled to the detected ground voltage such as the detected ground voltages VSSdet (0:5). A non-inverting terminal of the operational amplifier OP may be coupled to the detected supply voltage such as the detected supply voltages VDDdet (0:5). For example, the operational amplifier OP and the resistors R1 through R6, R13 and R14 may be used to generate a ground voltage average for monitoring the detected ground voltages VSSdet (0:5). The operational amplifier OP and the resistors R7 through R12, R15 and R16 may be used to generate a supply voltage average for monitoring the detected supply voltages VDDdet (0:5). The operational amplifier OP may generate a difference between the ground voltage average and the supply voltage average. The difference may be sent to the control circuit 180 via the overvoltage protection circuit 184 to update the supply voltage VDD according to the difference. The overvoltage protection circuit 184 may comprise a switch SW, a microcontroller (MCU) 1840 and a voltage divider 1842. The voltage divider 1842 may comprise the resistors R17 and R18. The voltage divider 1842 may detect the supply voltage VDD and transmit a detection result to the microcontroller 1840. When the detection result exceeds the predetermined high voltage, the microcontroller 1840 may output an overvoltage signal to the control circuit 180 to update the supply voltage VDD with the predetermined high voltage, and open the switch SW to disconnect the voltage compensation circuit 182 from the control circuit 180. In some embodiments, the control circuit 180 may comprise, but is not limited to, various functions or pins such as a switch SW, a ground GND, a power good pin PGOOD, a feedback voltage pin FB, an enabling pin EN, a circuit supply voltage VCC, a power input voltage VIN and/or a bootstrap element BOOT. For example, the power good pin PGOOD may provide a function of providing a power good signal when an output voltage is stable and ready to satisfy the power requirement of a circuit, so as to enable the circuit inside a power adapter to start operating and supply power to the device. The feedback voltage pin FB may provide a compensation voltage to further stabilize the output voltage. The bootstrap element BOOT may boost a voltage.

Figure 4:
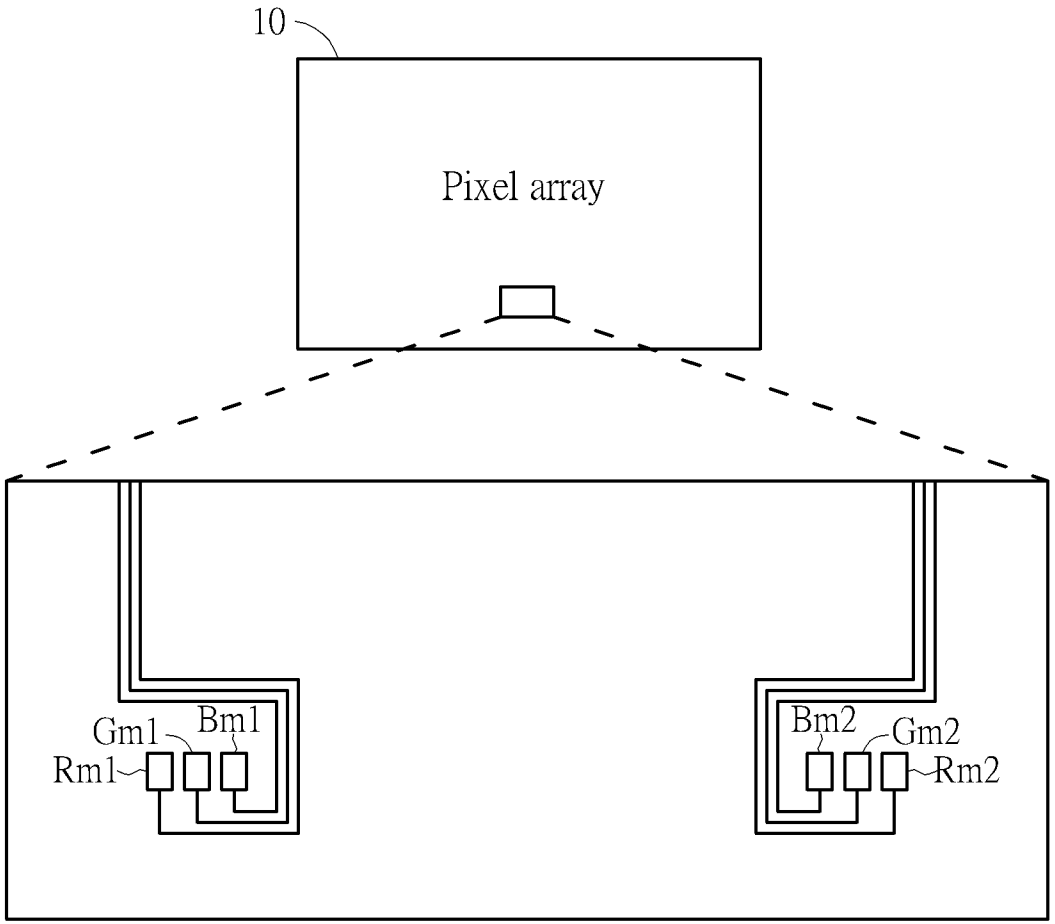
FIG. 4 is a schematic of a part of a soldering area of the pixel array in the display device in FIG. 1.

FIG. 4 is a schematic of apart of a soldering area of the pixel array 10 in the display device 1 in FIG. 1. A peripheral area of the pixel array 10, such as a soldering area, may comprise a conductive pad Rm1, a conductive pad Gm1, a conductive pad Bm1, a conductive pad Rm2, a conductive pad Gm2 and a conductive pad Bm2. In one embodiment, each pixel P(M,N) in the pixel array 10 may comprise, but is not limited to, a plurality of sub-pixels such as 3 or 4 sub-pixels. Each sub-pixel may be, but is not limited to, red, green and blue sub-pixels. Each sub-pixel may have an independent supply voltage VDD(M,N), and the red, green and blue sub-pixels may share a common ground voltage VSS(M,N). For example, sub-pixel supply voltages VDD (M,N) of two pixels at selected locations of the pixel array 10 may be transmitted to the power supply circuit 18 via the conductive pads Rm1, Gm1, Bm1 and the conductive pads Rm2, Gm2, Bm2, and then via the plurality of power detection lines 16 and the plurality of ground detection lines 17, respectively, so as to adjust the supply voltage VDD and/or the ground voltage VSS.

The display device 1 in FIGS. 1 through 4 may be used to detect internal voltages of the pixel array 10 so as to provide a sufficient supply voltage VDD and an accurate ground voltage VSS to the pixel array 10.

Those skilled in the art will readily observe that numerous modifications and alterations of the device and method may be made while retaining the teachings of the disclosure. Accordingly, the above disclosure should be construed as limited only by the metes and bounds of the appended claims.

What is claimed is:

1. A display device comprising:

a pixel array;

a power line;

a ground line;

a plurality of power detection lines;

a plurality of ground detection lines; and a power supply circuit, configured to provide to the pixel array a supply voltage via the power line and a ground voltage via the ground line, receive from the pixel array a plurality of detected supply voltages via the plurality of power detection lines and a plurality of detected ground voltages via the plurality of ground detection lines, and adjust the supply voltage and/or the ground voltage according to the plurality of detected supply voltages and the plurality of detected ground voltages;

wherein the plurality of detected supply voltages are obtained from a plurality of different locations in the pixel array, and the plurality of detected ground voltages are obtained from the plurality of different locations in the pixel array.

2. The display device of claim 1, wherein the power supply circuit comprises:

a voltage-averaging circuit, coupled to the pixel array, and configured to generate a supply voltage average according to the plurality of detected supply voltages, and generate a ground voltage average according to the plurality of detected ground voltages;

a voltage difference circuit, coupled to the voltage-averaging circuit, and configured to generate a difference according to the supply voltage average and the ground voltage average; and a control circuit, coupled to the voltage difference circuit, and configured to update the supply voltage and/or the ground voltage according to the difference.

3. The display device of claim 2, wherein the power supply circuit comprises:

an overvoltage protection circuit, coupled to the control circuit and the power line, and configured to output an overvoltage signal to the control circuit to update the supply voltage with the predetermined high voltage when the supply voltage exceeds a predetermined high voltage.

4. The display device of claim 2, wherein the power supply circuit comprises:

an overvoltage protection circuit, coupled to the control circuit and the ground line, and configured to output an overvoltage signal to the control circuit to update the ground voltage with the predetermined low voltage when the ground voltage is lower than a predetermined low voltage.

5. The display device of claim 2, wherein when the difference is less than a predetermined value, the control circuit is configured to increase the supply voltage and/or decrease the ground voltage.

6. The display device of claim 2, wherein when the difference exceeds a predetermined value, the control circuit is configured to decrease the supply voltage and/or increase the ground voltage.

7. A display device comprising:

a pixel array;

a power line;

a ground line;

a single power detection line;

a single ground detection line; and a power supply circuit, configured to provide to the pixel array a supply voltage via the power line and a ground voltage via the ground line, receive from the pixel array a single detected supply voltage via the single power detection line and a single detected ground voltage via the single ground detection line, and adjust the supply voltage and/or the ground voltage according to the single detected supply voltage and the single detected ground voltage, the power supply circuit comprising:

a voltage difference circuit, coupled to the pixel array, and configured to generate a difference according to the single supply voltage and the single ground voltage; and a control circuit, coupled to the voltage difference circuit, and configured to update the supply voltage and/or the ground voltage according to the difference.

8. The display device of claim 7, wherein the power supply circuit comprises:

an overvoltage protection circuit, coupled to the control circuit and the power line, and configured to output an overvoltage signal to the control circuit to update the supply voltage with the predetermined high voltage when the supply voltage exceeds a predetermined high voltage.

9. The display device of claim 7, wherein the power supply circuit comprises:

an overvoltage protection circuit, coupled to the control circuit and the ground line, and configured to output an overvoltage signal to the control circuit to update the ground voltage with the predetermined low voltage when the ground voltage is lower than a predetermined low voltage.

* * * * *